US005462101A

United States Patent [19]

Mouchmouchian

[11] Patent Number: 5,462,101

[45] Date of Patent: Oct. 31, 1995

[54] BABY FEEDING SYSTEM

[76] Inventor: Silva Mouchmouchian, 19401 Haynes St., #12, Reseda, Calif. 91335

[21] Appl. No.: 270,686

[22] Filed: Jul. 5, 1994

[51] Int. Cl.[6] ..... B65B 1/04; B65B 3/00

[52] U.S. Cl. ..... 141/364; 141/18; 141/319; 141/346; 141/366; 222/192; 222/205; 222/528; 285/177

[58] Field of Search ..... 141/364, 319, 141/346, 366, 386, 391, 106, 108, 109, 367, 18, 363, 365, 369, 372, 382, 384; 222/192, 205, 528; 285/177

[56] References Cited

U.S. PATENT DOCUMENTS

| | | | |
|---|---|---|---|
| 1,910,900 | 5/1933 | Johnson | 285/177 |
| 2,768,844 | 10/1956 | Schadeberg | 285/177 |
| 2,982,432 | 5/1961 | Mehl | 215/11.1 |
| 4,091,965 | 5/1978 | Gebhard | 222/192 |
| 4,830,222 | 5/1989 | Read | 222/192 |
| 5,000,314 | 3/1991 | Fuller et al. | 206/221 |
| 5,305,928 | 4/1994 | Verdaguer | 222/192 |

*Primary Examiner*—Henry J. Recla
*Assistant Examiner*—Steven O. Douglas
*Attorney, Agent, or Firm*—Allan M. Shapiro

[57] ABSTRACT

The system includes a coupler which attaches to both a baby food jar and a squeezable baby bottle so that the baby food jar can be inverted on the squeezable bottle to gravitationally transfer the baby food without spilling. Thereafter, a nozzle attaches to the coupler or directly to the squeezable baby bottle. The nozzle terminates in a baby feeding spoon. A manual valve is fitted into the nozzle to close it when desired.

15 Claims, 3 Drawing Sheets

FIG. 1
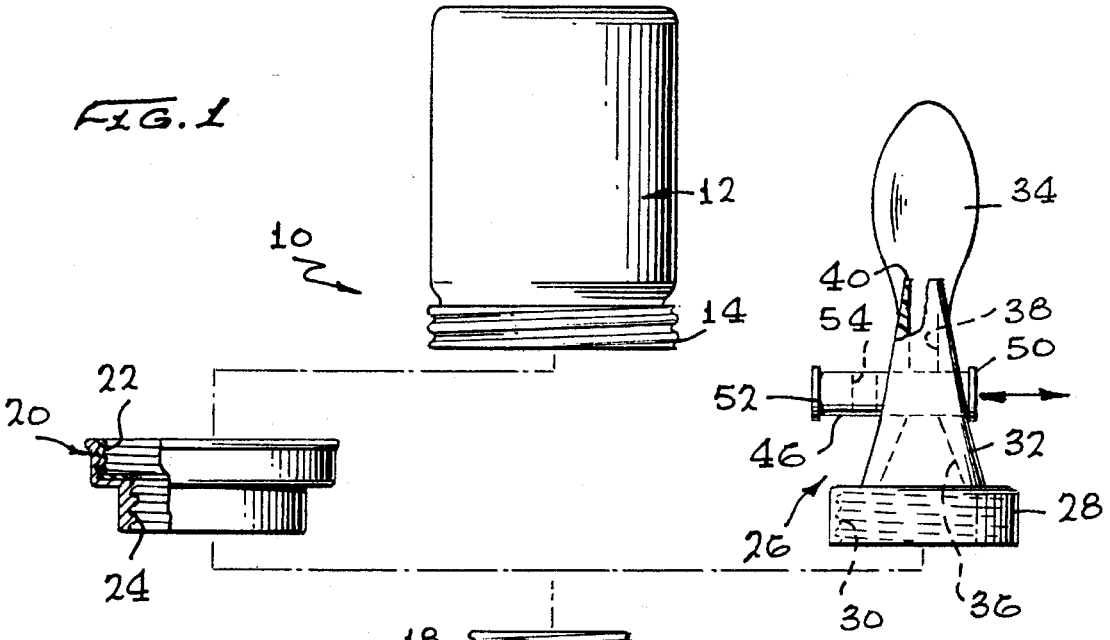
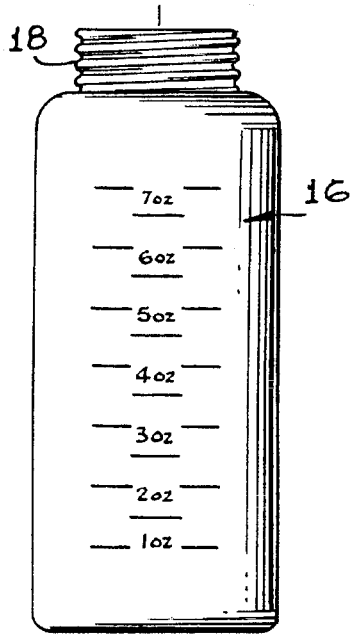
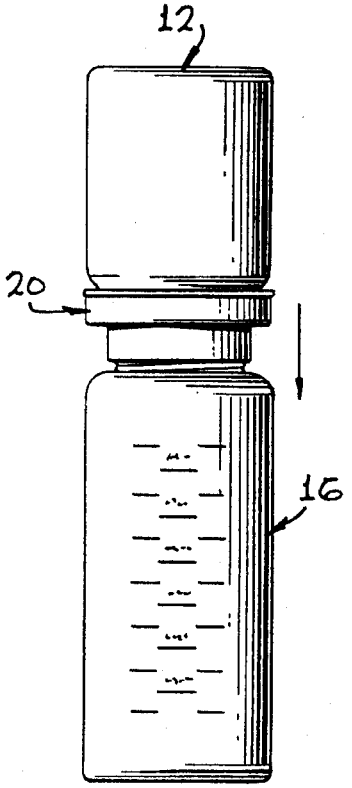
FIG. 2

BABY FEEDING SYSTEM

FIELD OF THE INVENTION

This invention is directed to a baby feeding system which includes both a coupler which attaches an inverted baby food jar to the top of a squeezable bottle and includes a spoon-carrying nozzle which attaches to the coupler or attaches to the squeezable baby bottle, now containing baby food.

BACKGROUND OF THE INVENTION

Initially, babies are fed with milk or a nutritionally balanced milk substitute. Except for nursing the baby, the milk is usually delivered by a baby bottle. The baby bottle comprises a vessel and a rubber nipple configured in size for the baby's mouth. A number of different kinds of vessels are available, including rigid glass vessels, substantially rigid synthetic polymer composition material vessels, squeezable polymer vessels, and thin-walled polymer bags, often employed in a holder.

As the baby grows, his feeding is supplemented with "solid" foods. These foods are not really solid, but are semi-fluid in nature. These foods include smooth oatmeal, smooth fruit, smooth vegetables and smooth meat, usually chicken. These food materials are pureed and adjusted in viscosity. In manufacture, they are placed in jars and sterilized. The jars are closed with screw caps which are removed for feeding of the baby. Conventionally, the mother uses a small spoon, scoops a small amount of this pureed food from the jar, and uses the spoon to place it in the baby's mouth. This feeding often takes place with the baby in a seated, upright position and held in position, as in a high chair. This is usually a two-handed operation because the baby food jar must be held in one hand while the pureed baby food is spooned out. This is particularly true when there is not an adjacent table on which to place the baby food jar.

While this invention is described in association with pureed baby food, it is clear that it can also be used with junior baby food which includes chopped food with the puree. Thus, use of the system is practical when any baby food has the proper fluidity and its individual components are not too large to pass through the openings of the system. Of course, this process is utilized numerous times for each baby and, thus, is a process which is repeated many times each day throughout the United States. There is need for achieving the process more easily.

SUMMARY OF THE INVENTION

In order to aid in the understanding of this invention, it can be stated in essentially summary form that it is directed to a baby feeding system which includes a coupler which attaches to a baby food jar and a squeezable bottle to efficiently transfer pureed baby food from jar to bottle without mess and which includes a nozzle which subsequently attaches directly or indirectly to the squeezable baby bottle. The nozzle has an integral spoon formed therewith and has a valve which selectively shuts off the nozzle so that the baby may be fed pureed food on the spoon and, when feeding is complete, the valve can close the nozzle.

It is thus an object and advantage of this invention to provide a baby feeding system which includes a coupler which transfers baby food from a jar to a squeezable bottle without mess and without the opportunity for exterior contamination.

It is another object and advantage of this invention to provide a baby feeding system which includes a squeezable baby bottle together with a nozzle which attaches thereto and a shutoff valve on the nozzle so that, when the valve is open, baby food can be extruded from the bottle onto the integral spoon; and, when feeding is complete, the valve can be closed to avoid contamination of the food remaining in the bottle.

It is another object and advantage of this invention to provide a baby feeding system which is economic of construction and which is easy to use so that it may be widely utilized.

It is another object and advantage of this invention to provide a baby feeding system which permits the user to feed the baby with only one hand, without having to manipulate the baby food jar.

It is a further object and advantage of this invention to provide a baby feeding system which avoids contamination of the baby food during transfer from jar to bottle by employment of a coupler therebetween and which avoids contamination of the baby food after it is in the bottle by having a valve in the nozzle which can be closed during non-use.

The features of the present invention which are believed to be novel are set forth with particularity in the appended claims. The present invention, both as to its organization and manner of operation, together with further objects and advantages thereof, may be best understood by reference to the following description, taken in conjunction with the accompanying drawings.

BRIEF DESCRIPTION OF THE DRAWINGS

FIG. 1 is a side-elevational view of the first preferred embodiment of the system showing the components of the system in relationship to each other.

FIG. 2 shows the coupler of this system employed in transferring baby food from a baby food jar to a squeezable baby bottle.

DESCRIPTION OF THE PREFERRED EMBODIMENT

Figure 3:
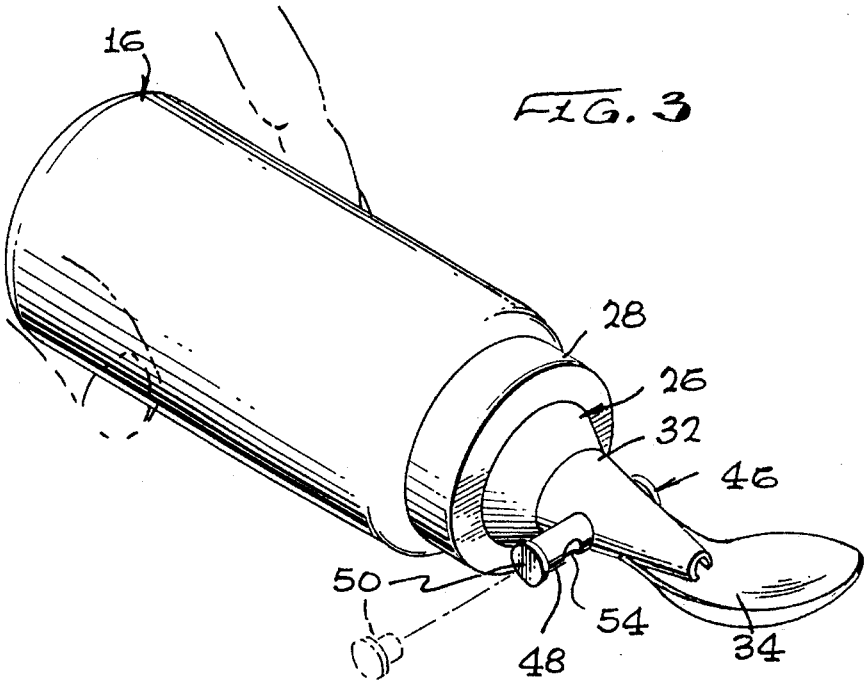
FIG. 3 is an isometric view of the nozzle of the system shown in association with a squeezable baby bottle.

The first preferred embodiment of the baby feeding system is generally indicated at 10 in FIG. 1. The system comprises a standard baby food jar 12. The baby food in the jar is either pureed or finely chopped. The jar 12 comes supplied with a screw thread 14 around its neck to which the conventional jar top is attached by the manufacturer. As long as this jar top stays in place, the contents of the baby food jar remain sterile. The jar is conventionally rigid; for example, being made of glass. The baby feeding system also includes baby bottle 16. The baby bottle 16 is provided with screw threads 18 around its neck. The baby bottle 16 is made of synthetic polymer composition material and is of such thickness and of such resiliency that the bottle 16 is squeezable to expel the contents. Such baby bottles are conventionally provided with volume marks to indicate to the person doing the feeding the amount of remaining milk or baby food therein. In the present invention, the baby food bottle 16 is a commercially available squeeze bottle.

Coupler 20 is shown in FIGS. 1 and 2. The coupler 20 has an upper interior recess which has screw threads 22 on the exterior thereof. It also has a lower recess which has screw threads 24 on the exterior surface thereof. The screw threads 22 are sized to fit on screw threads 14, and the screw threads 24 are sized to fit on screw threads 18. The recesses are open to each other. In use, the screw top of the baby food jar 12 is removed with the jar in the upright position, and the coupler 20 is threaded onto the baby food jar. The baby bottle 16, now empty, is mouth down on the top of that combination, and its screw threads 18 are engaged into the screw threads 24 and coupler 20. Now the combination is inverted so that the baby food gravitates from the jar through the coupler into the bottle. This can be done ahead of time to maximize transfer of baby food from the jar into the bottle, This position is shown in FIG. 2.

When it is desired that the baby be fed, nozzle 26 is attached to the baby bottle 16. Nozzle 26 (see FIGS. 1, 3 and 4) has a collar 28. The collar has interior screw threads 30 which are sized to engage with screw threads on the neck of baby bottle 16. The body 32 of the nozzle extends forward from the collar and terminates in spoon 34. The spoon is sized, like other baby spoons, to fit easily in the mouth of a baby. The word "baby" has been used to designate the person receiving the food and is intended to mean babies and infants through the ages of feeding solid feed, whether pureed or chopped junior foods.

Figure 4:
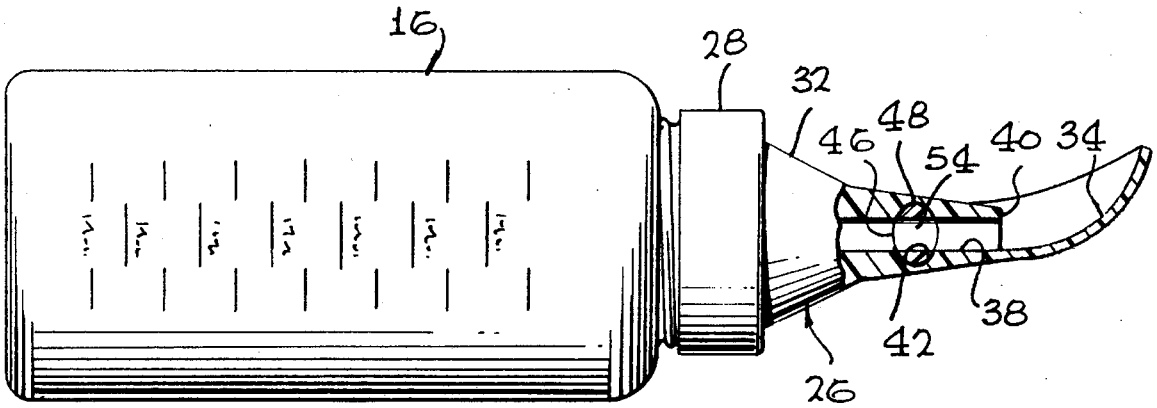
FIG. 4 is a side-elevational view of the structure in FIG. 3, with parts broken away and parts taken in section.

Interiorly of the nozzle is conical passage 36 which extends from interiorly of the collar forwardly in the nozzle. The conical passage joins cylindrical passage 38, which is seen in FIGS. 1 and 4. The cylindrical passage 38 terminates at the front end 40 of the nozzle, where spoon 34 joins the nozzle. The nozzle, including its collar, body and spoon is preferably integrally molded as one piece of thermoplastic synthetic polymer composition material so that it can be manufactured in large quantities so as to be readily available. The coupler can be made of similar materials in a similar way.

In order to avoid contamination of the baby food when it is in the baby bottle, a valve is provided to close the passage 38. Valve bore 42 extends crosswise of the nozzle completely intersecting cylindrical passage 38, as seen in FIG. 4. Valve plunger 46 is positioned in the valve bore. The valve plunger is actually slidable on its own axis and the axis of the valve bore because both are of the same cross-sectional configuration and sized to be slidable. In order to prevent rotation of the valve plunger in the valve bore, they are preferably of non-round configuration. This configuration may be oval, as shown in FIG. 4, or other non-round cross-section such as square or substantially cylindrical with a key engaging in a keyway. The non-round configuration is necessary to prevent rotation of the valve plunger. The valve plunger has caps 50 and 52, respectively, at each end to prevent the plunger from sliding out of the bore. The cap 50 may be removable, as illustrated in FIG. 3, so that the valve plunger can be assembled into the valve bore. After assembly, the cap 50 is secured in place. In addition, valve plunger 46 has an opening 54 therethrough which aligns with the cylindrical passage 38 when the valve plunger is pushed into the open position. It is because of this opening 54 that the plunger 46 is prevented from rotating in this bore. When in the closed position shown in FIGS. 1 and 3, the opening is out of line with the passage 38 so that the valve is closed. The valve plunger is conveniently located so that it could be finger-operated by the person feeding the baby so that the valve can be closed quickly when feeding is terminated.

Figure 5:
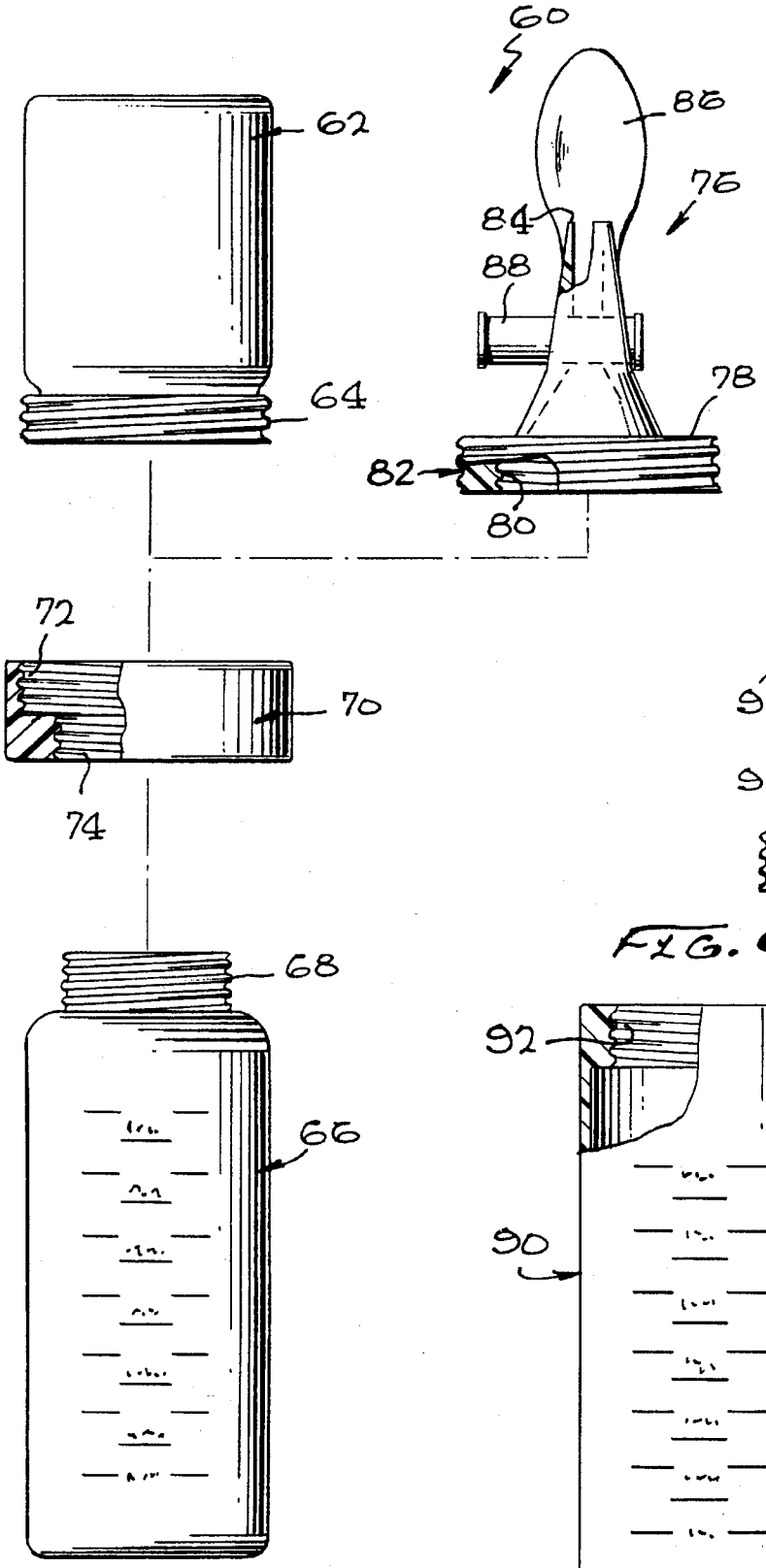
FIG. 5 is a side-elevational view of the second preferred embodiment of the system showing the components of the system in relationship to each other, with parts of the components broken away and taken in section.

Baby feeding system 60 is shown in FIG. 5. It includes a baby food jar 62 which has external screw threads 64 around its mouth. The system 60 also includes a squeezable baby bottle 66 with external screw threads 68 around its mouth. Coupler 70 has a recess which contains therein screw threads 72 sized to fit the screw threads 64. The coupler also contains a recess which has therein screw threads 64, which are sized to fit the screw threads 68 on the squeezable baby bottle. Thus, the combination of baby food jar 62, coupler 70 and squeezable baby bottle 66 are the same as the combination shown in FIG. 2. They are used in that way to empty the contents of the baby food jar into the squeezable baby bottle.

Nozzle 76 has a collar 78 which has internal screw threads 80, which fit on the screw threads 68 at the mouth of the squeezable baby bottle 66. In addition, the collar 78 has external screw threads 82 which are the same size as the screw threads 68 on the baby food jar and which can engage the screw threads 72 in coupler 70. In this way, the baby feeding system 60 of FIG. 5 can transfer baby food from the baby food jar 62 through coupler 70 into squeezable baby bottle 66. Once the transfer is completed, the baby food jar 62 can be unscrewed from the coupler and, thereupon, the nozzle 76 can be screwed into the coupler by way of its external threads 82.

The remainder of the nozzle 76 is the same as nozzle 26. It has an internal passage 84 which leads to spoon 86. A valve plunger 88 extends across the passage 82 to selectively open and close the passage between the squeezable baby bottle and the spoon.

The coupler 70 is necessitated by the difference in screw threads between the standard baby food jar and the standard squeezable baby bottle. Squeezable baby bottle 90 is the same as the baby bottle 66 except that it is provided with internal screw threads 92 in its mouth. These internal screw threads are sized to receive the screw threads 64 on a standard baby food jar. Thus, the coupler is not necessary when the baby bottle is configured in this way. The nozzle 76, with its external screw threads 82, can be screwed directly into the mouth of the squeezable baby bottle 90.

Figure 7:
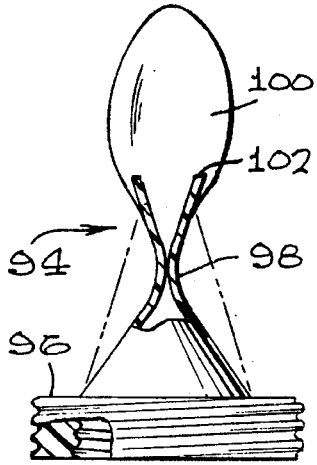
FIG. 7 is a side-elevational view, with parts broken away and parts taken in section, of a further embodiment of the nozzle structure with its valve and integral spoon in accordance with this invention.
Figure 6:
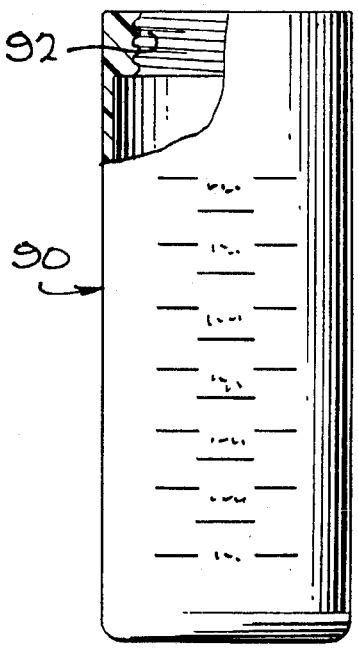
FIG. 6 is a side-elevational view, with parts broken away and parts taken in section, of another embodiment of a squeezable baby bottle for use in the system of this invention.

Nozzle 94 has a collar 96 which has both internal and external screw threads, the same as nozzle 76. Thus, the nozzle 94 can be screw-threaded onto either the top of squeezable standard baby bottle 66 or squeezable special baby bottle 90. The nozzle 94 has a flexible conical body 98 to which is attached spoon 100. The body ends with face 102 at the spoon. The nozzle is molded of resilient material and its body is molded of such thickness of the resilient material that, in the unstressed position, the walls of the conical body normally squeeze themselves together to close the passage through the body. Thus, there is valving which automatically closes when food is not being squeezed therethrough. If more of the baby food is desired on the spoon, the person feeding the baby squeezes the squeezable baby bottle, and the pressure in the squeezable baby bottle then is sufficient to force the food through the resiliently closed neck of the flexible conical body. Dashed lines in FIG. 7 show the nozzle in the open position, as when food is being extruded therethrough. In this way, closure is achieved without the need for manual valve actuation.

This invention has been described in its presently contemplated best modes, and it is clear that it is susceptible to numerous modifications, modes and embodiments within the ability of those skilled in the art and without the exercise of the inventive faculty. Accordingly, the scope of this invention is defined by the scope of the following claims.

What is claimed is:

1. A baby feeding system comprising:

a coupler, said coupler being open therethrough, said coupler having first detachable attachment means for attachment to the neck of a jar of baby food and having second detachable attachment means for attachment to the neck of a squeezable baby bottle so that a jar of baby food and a squeezable baby bottle can both be detachably attached to said coupler with the jar of baby food inverted so that the food is gravitationally transferred into the squeezable baby bottle; and a baby food dispenser, said baby food dispenser having attachment means thereon for detachable attachment to the neck of the squeezable baby bottle from which said coupler has been removed, said dispenser having a dispenser opening therethrough and having a spoon attached thereto so that the baby bottle can be squeezed and dispense food through said dispenser opening onto said spoon for feeding a baby, and a valve in said dispenser opening for selectively closing said dispenser opening.

2. The baby feeding system of claim 1 wherein said first and second attachment means on said coupling are at least partial screw threads and said attachment means on said dispenser are at least partial screw threads.

3. The baby feeding system of claim 1 wherein said dispenser comprises a collar which contains said attachment means and a nozzle mounted on said collar, said nozzle extending forwardly from said collar and terminating in a front face, said dispenser opening extending through said nozzle to said front face, said spoon extending forwardly from said front face.

4. The baby feeding system of claim 3 wherein said collar, said nozzle and said spoon are integrally formed.

5. The baby feeding system of claim 4 wherein said dispenser is molded of thermoplastic synthetic polymer composition material.

6. The baby feeding system of claim 5 wherein there is a transverse valve bore through said nozzle intersecting said dispenser opening therethrough, said valve bore containing a valve plunger which comprises said valve, said valve plunger having an opening therethrough so that in one position, said opening through said valve plunger is in alignment with said dispenser opening through said nozzle to permit dispenser of baby food through said dispenser opening through said nozzle and in a second position of said valve plunger, said valve plunger obstructs said dispenser opening through said nozzle to close said nozzle.

7. The baby feeding system of claim 6 wherein said plunger has means thereon to inhibit rotation to maintain the opening through said plunger parallel to said opening through said nozzle.

8. The baby feeding system of claim 7 wherein said means to prevent rotation is a non-round configuration of said plunger and said valve bore.

9. The baby feeding system of claim 7 further including means interengaging said plunger and said nozzle to inhibit removal of said plunger said from said valve bore.

10. The baby feeding system of claim 9 wherein said means to inhibit removal of said valve plunger from said valve bore comprises a cap on each end of said valve plunger.

11. A baby feeding system comprising:

a coupler, said coupler being open therethrough, said coupler having first detachable attachment means for attachment to the neck of a jar of baby food and having second detachable attachment means for attachment to the neck of a squeezable baby bottle so that a jar of baby food and a squeezable baby bottle can both be detachably attached to said coupler with the jar of baby food inverted so that the food is gravitationally transferred into the squeezable baby bottle;

a baby food dispenser, said baby food dispenser having a collar which contains attachment means for detachable attachment to the neck of a squeezable baby bottle from which said coupler has been removed, a nozzle mounted on said collar and extending forwardly from said collar and terminating in a front face, a dispenser opening through said collar and said nozzle to said front face of said nozzle, a spoon attached to said nozzle and extending forward from said front face so that the baby bottle can be squeezed and dispense food through said dispenser opening through said nozzle onto said spoon for feeding a baby; and a transverse valve bore through said nozzle intersecting said dispenser opening therethrough, said valve bore containing a valve plunger, said valve plunger having an opening therethrough so that in one position, said opening through said valve plunger is in alignment with said dispenser opening through said nozzle to permit dispensing of baby food through said dispenser opening through said nozzle and in a second position of said valve plunger, said valve plunger obstructs said dispenser opening through said nozzle to close said nozzle.

12. The baby feeding system of claim 11 wherein said plunger has means thereon to inhibit rotation to maintain the opening through said plunger parallel to said opening through said nozzle.

13. The baby feeding system of claim 12 further including means interengaging said plunger and said nozzle to inhibit removal of said plunger said from said valve bore.

14. The baby feeding system of claim 13 wherein said means to inhibit removal of said valve plunger from said valve bore comprises a cap on each end of said valve plunger.

15. A dispenser for dispensing baby food from a squeezable baby bottle, comprising:

a coupler, said coupler having attachment means thereon for detachable attachment to the neck of a squeezable baby bottle, said coupler also having attachment means thereon sized for detachable attachment to the neck of a baby food jar, said coupler having an opening therethrough so that a baby food jar may be mounted on said coupler and said coupler may be mounted on a squeezable baby bottle for the transfer of food from the baby food jar to the squeezable baby bottle;

a collar, said collar having attachment means thereon for detachable attachment to the neck of a squeezable baby bottle, nozzle attached to said collar, said collar and said nozzle having an opening therethrough, said nozzle terminating at a front face, a spoon attached to said nozzle and extending beyond said front face so that squeezing of a baby bottle attached thereto dispenses baby food through said nozzle onto said spoon;

a valve in said opening through said nozzle, said valve having a first, open position wherein said valve does not obstruct said opening through said nozzle and a second, closed position wherein said valve obstructs said opening through said nozzle to inhibit dispensing of food from said squeezable baby bottle onto said spoon and to inhibit passage of materials from said front face into the baby bottle attached to said dispenser.

* * * * *